US010340575B2

(12) United States Patent
Tanaka

(10) Patent No.: US 10,340,575 B2
(45) Date of Patent: Jul. 2, 2019

(54) DIRECTIONAL COUPLER

(71) Applicant: Murata Manufacturing Co., Ltd., Nagaokakyo-shi, Kyoto-fu (JP)

(72) Inventor: Akira Tanaka, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 54 days.

(21) Appl. No.: 15/835,491

(22) Filed: Dec. 8, 2017

(65) Prior Publication Data

US 2018/0102582 A1 Apr. 12, 2018

Related U.S. Application Data

(63) Continuation of application No. PCT/JP2016/068275, filed on Jun. 20, 2016.

(30) Foreign Application Priority Data

Jul. 14, 2015 (JP) ..... 2015-140110

(51) Int. Cl.
*H01P 5/18* (2006.01)
*H01P 3/08* (2006.01)
*H01P 1/203* (2006.01)

(52) U.S. Cl.
CPC ..... *H01P 5/18* (2013.01); *H01P 5/184* (2013.01); *H01P 1/2039* (2013.01)

(58) Field of Classification Search
CPC ..... H01P 5/08; H01P 5/18; H01P 3/08
USPC ..... 333/109–112, 116
See application file for complete search history.

(56) References Cited

U.S. PATENT DOCUMENTS

| | | | | |
|---|---|---|---|---|
| 8,629,736 | B2 * | 1/2014 | Tamaru | H01P 5/18 333/109 |
| 9,000,864 | B2 * | 4/2015 | Tanaka | H01P 5/185 333/116 |
| 9,385,411 | B2 * | 7/2016 | Ohashi | H01P 5/187 |
| 9,391,354 | B2 * | 7/2016 | Ootsuka | H01P 5/185 |
| 9,893,407 | B2 * | 2/2018 | Ootsuka | H01P 5/18 |
| 9,893,408 | B2 * | 2/2018 | Ashida | H01P 5/18 |
| 10,084,225 | B2 * | 9/2018 | Ashida | H01P 5/18 |
| 2012/0161897 | A1 | 6/2012 | Tamaru et al. | |

(Continued)

FOREIGN PATENT DOCUMENTS

| | | |
|---|---|---|
| JP | 10-290108 A | 10/1998 |
| JP | 2013-005076 A | 1/2013 |
| JP | 2013-046305 A | 3/2013 |

(Continued)

OTHER PUBLICATIONS

Official Communication issued in International Patent Application No. PCT/JP2016/068275, dated Aug. 23, 2016.

*Primary Examiner* — Dean O Takaoka
(74) *Attorney, Agent, or Firm* — Keating & Bennett, LLP

(57) ABSTRACT

A directional coupler includes an input terminal, an output terminal, a coupling terminal, a termination terminal, a first ground terminal, second ground terminals, a main line, a first sub line, and a second sub line. A first low pass filter is included between the coupling terminal and the first sub line. A second low pass filter is included between the first sub line and the second sub line. The first low pass filter is electrically connected to the first ground terminal, and the second low pass filter is electrically connected to the second ground terminals.

19 Claims, 11 Drawing Sheets

(56) References Cited

U.S. PATENT DOCUMENTS

| | | | |
|---|---|---|---|
| 2012/0319797 | A1 | 12/2012 | Tamaru |
| 2015/0381134 | A1 | 12/2015 | Tanaka |

FOREIGN PATENT DOCUMENTS

| | | | |
|---|---|---|---|
| JP | 2016-012770 | A | 1/2016 |
| WO | 2011/074370 | A1 | 6/2011 |

* cited by examiner

COUPLING CHARACTERISTICS

FREQUENCY CHARACTERISTICS OF LPF1 AND LPF2

INSERTION LOSS CHARACTERISTICS · RETURN LOSS CHARACTERISTICS

COUPLING CHARACTERISTICS IN COMPARATIVE EXAMPLE

COMPARISON OF COUPLING CHARACTERISTICS OF DIRECTIONAL COUPLER 100 AND COUPLING CHARACTERISTICS OF DIRECTIONAL COUPLER 200

DIRECTIONAL COUPLER

CROSS REFERENCE TO RELATED APPLICATIONS

This application claims the benefit of priority to Japanese Patent Application No. 2015-140110 filed on Jul. 14, 2015 and is a Continuation Application of PCT Application No. PCT/JP2016/068275 filed on Jun. 20, 2016. The entire contents of each application are hereby incorporated herein by reference.

BACKGROUND OF THE INVENTION

1. Field of the Invention

The present invention relates to a directional coupler. More specifically, the present invention relates to a directional coupler in which a curve of the degree of coupling is flat or substantially flat over a wide frequency band, and in which coupling in an unnecessary frequency band is significantly reduced.

2. Description of the Related Art

In high-frequency devices, a directional coupler is used that extracts part of a high-frequency signal to measure characteristics of the high-frequency signal. In directional coupler having a typical structure, a main line connected between an input terminal and an output terminal and a sub line connected between a coupling terminal and a termination terminal are disposed in parallel with each other, and part of a high-frequency signal flowing through the main line is extracted from the sub line.

In directional couplers, it is desired that a curve of the degree of coupling is flat over a wide frequency band, and that coupling in an unnecessary frequency band (for example, a frequency band on a higher-frequency side than a frequency band used in coupling) is reduced.

For example, in a directional coupler disclosed in Japanese Unexamined Patent Application Publication No. 2013-46305, a low pass filter is inserted between a coupling terminal and a sub line, thereby reducing coupling in an unnecessary frequency band on a high-frequency side, and making a curve of the degree of coupling flat over a wide frequency band.

Furthermore, in a directional coupler disclosed in Japanese Unexamined Patent Application Publication No. 2013-5076, a sub line is divided into a first sub line and a second sub line, and a low pass filter is inserted between the first sub line and the second sub line, thereby reducing coupling in an unnecessary frequency band on a high-frequency side, and making a curve of the degree of coupling flat over a wide frequency band.

The directional couplers disclosed in Japanese Unexamined Patent Application Publication No. 2013-46305 and Japanese Unexamined Patent Application Publication No. 2013-5076 have some effects on a reduction in coupling in an unnecessary frequency band on a high-frequency side and flattening of a curve of the degree of coupling over a wide frequency band. However, it is desired by manufacturers and sellers of electronic devices that uses directional couplers that a reduction in coupling in an unnecessary frequency band and flattening of a curve of the degree of coupling over a wide frequency band are further advanced.

As a method for responding to such desires, first, a method is considered in which the low pass filter inserted between the coupling terminal and the sub line, or the low pass filter inserted between the first sub line and the second sub line is divided into multiple stages. As another method, a method obtained by combining the method disclosed in Japanese Unexamined Patent Application Publication No. 2013-46305 and the method disclosed in Japanese Unexamined Patent Application Publication No. 2013-5076 is considered in which a low pass filter is inserted both between the coupling terminal and the sub line and between the first sub line and the second sub line.

However, even if the low pass filter is divided into multiple stages, the size of the directional coupler is remarkably increased, and there is no desired improvement in characteristics. Furthermore, even if a low pass filter is simply inserted both between the coupling terminal and the sub line and between the first sub line and the second sub line, unnecessary leakage of a signal occurs in the directional coupler, and there is no desired improvement in characteristics.

SUMMARY OF THE INVENTION

A directional coupler according to a preferred embodiment of the present invention includes an input terminal; an output terminal; a coupling terminal; a termination terminal; a ground terminal; a main line electrically connected between the input terminal and the output terminal; and a sub line electrically connected between the coupling terminal and the termination terminal. The main line and the sub line are spaced away from each other. The sub line is divided into a plurality of sub lines electrically connected to each other and includes at least a first sub line and at least a second sub line. A first low pass filter is included between the coupling terminal and the sub line. A second low pass filter is included between the first sub line and the second sub line. The ground terminal includes a plurality of ground terminals including at least a first ground terminal and at least a second ground terminal that are isolated from each other. The first low pass filter is electrically connected to the first ground terminal, and the second low pass filter is electrically connected to the second ground terminal.

In a directional coupler according to a preferred embodiment of the present invention, for example, the first low pass filter may include at least a first inductor, at least a second inductor, at least a first capacitor, at least a second capacitor, and at least a third capacitor. The coupling terminal may be electrically connected to one end of the first inductor. The other end of the first inductor may be electrically connected to one end of the second inductor. The other end of the second inductor may be electrically connected to the sub line. The first capacitor may be electrically connected in parallel with the first inductor. The second capacitor may be electrically connected in parallel with the second inductor. The third capacitor may be electrically connected between a connection point between the first inductor and the second inductor and the first ground terminal. The second low pass filter may include at least a third inductor, at least a fourth inductor, at least a fourth capacitor, at least a fifth capacitor, and at least a sixth capacitor. The first sub line may be electrically connected to one end of the third inductor. The other end of the third inductor may be electrically connected to one end of the fourth inductor. The other end of the fourth inductor may be electrically connected to the second sub line. The fourth capacitor may be electrically connected between a connection point between the first sub line and the third inductor and the second ground terminal. The fifth capacitor may be electrically connected between a connection point between the third inductor and the fourth inductor and the second ground terminal. The sixth capacitor may be electrically connected between a connection point between the fourth inductor and the second sub line and the second ground terminal. In this case, the first low pass filter may provide an attenuation pole on a higher-frequency side than a frequency band used in coupling to increase attenuation on the higher-frequency side. The second low pass filter may make a curve of the degree of coupling flat or substantially flat over a wide frequency band.

Furthermore, in a directional coupler according to a preferred embodiment of the present invention, in the first low pass filter, one additional inductor or a plurality of additional inductors electrically connected in series with each other may be included between the second inductor and the sub line. Additional capacitors may be electrically connected in parallel with the respective additional inductors. In the case of the one additional inductor, an additional capacitor may be included between a connection point between the second inductor and the one additional inductor and the first ground terminal. In the case of the plurality of additional inductors, additional capacitors may be respectively included between a connection point between the second inductor and an additional inductor and the first ground terminal, and between a connection point between the additional inductor and an additional inductor and the first ground terminal. In this case, the number of stages of the first low pass filter may be increased, and characteristics of the directional coupler may be further improved.

Furthermore, in a directional coupler according to a preferred embodiment of the present invention, in the second low pass filter, one additional inductor or a plurality of additional inductors electrically connected in series with each other may be included between the fourth inductor and the second sub line. In the case of the one additional inductor, an additional capacitor may be included between a connection point between the one additional inductor and the second sub line and the second ground terminal. In the case of the plurality of additional inductors, additional capacitors may be respectively included between a connection point between an additional inductor and an additional inductor and the second ground terminal, and between a connection point between the additional inductor and the second sub line and the second ground terminal. In this case, the number of stages of the second low pass filter may be increased, and characteristics of the directional coupler may be further improved.

Furthermore, in a directional coupler according to a preferred embodiment of the present invention, a cutoff frequency of the first low pass filter may be different from a cutoff frequency of the second low pass filter, and the cutoff frequency of the first low pass filter may be on a higher-frequency side than the cutoff frequency of the second low pass filter. In this case, the cutoff frequency of the first low pass filter is different from the cutoff frequency of the second low pass filter, and thus, it is possible to make a curve of the degree of coupling flat or substantially flat over a wide frequency band and also to increase attenuation on the higher-frequency side than the frequency band used in coupling.

Furthermore, in a directional coupler according to a preferred embodiment of the present invention, an additional inductor may be further included in a connection path between the first low pass filter and the first ground terminal. In this case, an attenuation pole may be provided at a frequency on the higher-frequency side slightly further away from the frequency band used in coupling, and characteristics of the directional coupler may be further improved.

A directional coupler according to a preferred embodiment of the present invention may be included in a multilayer body including a plurality of insulator layers stacked on top of one another. A first ground electrode may be provided in a first interlayer space between the insulator layers, and a second ground electrode may be provided in a second interlayer space between the insulator layers. In the multilayer body, the first ground electrode and the second ground electrode may be isolated from each other. The first low pass filter may be electrically connected to the first ground electrode, and the second low pass filter may be electrically connected to the second ground electrode. The first ground electrode may be electrically connected to the first ground terminal, and the second ground electrode may be electrically connected to the second ground terminal. In this case, the first ground electrode and the second ground electrode are isolated from each other, and thus, it is possible to significantly reduce or prevent unnecessary leakage of a signal from occurring through a ground electrode and to further improve characteristics of the directional coupler.

When a directional coupler according to a preferred embodiment of the present invention is included in the multilayer body including the plurality of insulator layers stacked on top of one another, in the multilayer body, the second ground electrode may be divided into and located in two or more interlayer spaces between the insulator layers. In the multilayer body, the main line and the sub line may be individually sandwiched from above and below by divided second ground electrodes in the two or more interlayer spaces. When the multilayer body is viewed in perspective in a stacking direction, the divided second ground electrodes in the two or more interlayer spaces may at least partially overlap the main line and the sub line. In this case, the main line and the sub line are able to be significantly reduced or prevented from being affected by a noise signal from the outside.

Furthermore, when a directional coupler according to a preferred embodiment of the present invention is included in the multilayer body including the plurality of insulator layers stacked on top of one another, when the multilayer body is viewed in perspective in a stacking direction, the first low pass filter and the first ground electrode may at least partially overlap each other, but the first low pass filter may not overlap the second ground electrode. In this case, the number of ground electrodes acting as a barrier to a magnetic field generated by an inductor of the first low pass filter may be reduced, and thus, it is possible to increase attenuation on the higher-frequency side than the frequency band used in coupling and to further improve characteristics of the directional coupler.

The preferred embodiments of the present invention provide directional couplers in which unnecessary leakage of a signal does not occur, in which a curve of the degree of coupling is flat or substantially flat over a wide frequency band, and in which coupling in an unnecessary frequency band is significantly reduced.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention will be described below with reference to the drawings.

The present invention is exemplified by the following preferred embodiments, and the present invention is not limited to descriptions of the preferred embodiments. Furthermore, the present invention is able to be implemented by a combination of features, components, and elements described in different preferred embodiments, and features, components, and elements implemented in this case are also included in the present invention. Furthermore, the drawings aid in understanding the preferred embodiments, and figures are not necessarily drawn precisely in some cases. For example, a dimensional ratio of a drawn component or between drawn components does not coincide with a dimensional ratio of that or between those described in this specification in some cases. Furthermore, a component described in this specification is omitted in a drawing in some cases, and components described in this specification are drawn with the number of the components reduced in some cases, for example.

First Preferred Embodiment

Figure 1:
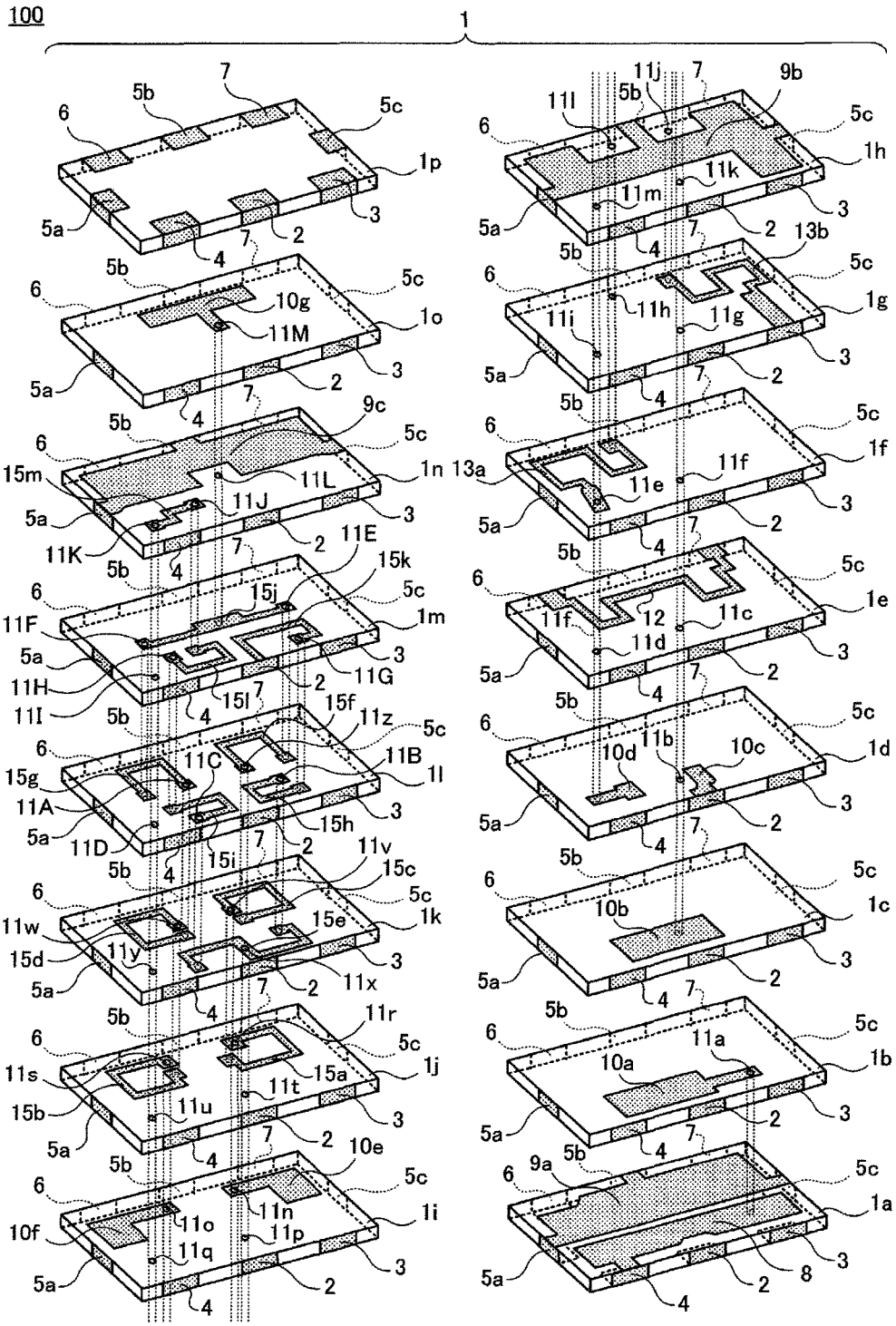
FIG. 1 is an exploded perspective view illustrating a directional coupler according to a first preferred embodiment of the present invention.
Figure 2:
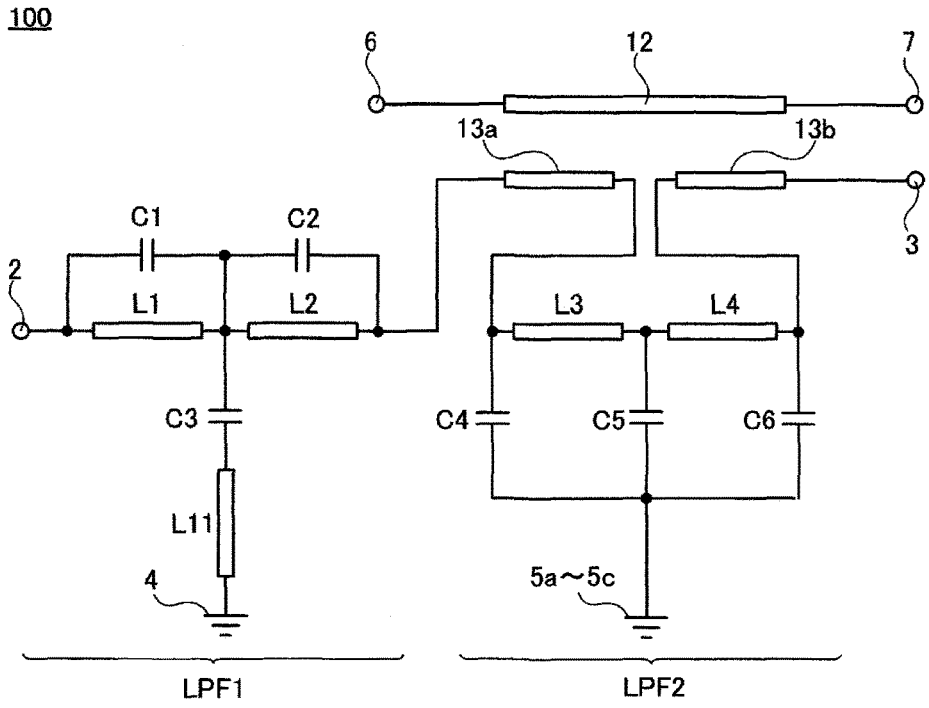
FIG. 2 is an equivalent circuit diagram of the directional coupler shown in FIG. 1.

FIGS. 1 and 2 each illustrate a directional coupler 100 according to a first preferred embodiment of the present invention. Note that FIG. 1 is an exploded perspective view of the directional coupler 100 structured with a multilayer body including a plurality of insulator layers stacked on top of one another. FIG. 2 illustrates an equivalent circuit into which the exploded perspective view of FIG. 1 is transformed.

As illustrated in FIG. 1, the directional coupler 100 includes a multilayer body 1 including 16 insulator layers 1*a* to 1*p* stacked on top of one another. The multilayer body 1 preferably has a rectangular parallelepiped or a substantially rectangular parallelepiped shape.

On four side surfaces of the multilayer body 1, certain terminals are provided. The terminals provided on the multilayer body 1 will be described below. For convenience of explanation, the terminals provided on the side surfaces will be described sequentially clockwise from a side surface on the near side in FIG. 1. Note that, in the following description, "near side", "left side", "far side", and "right side" each refer to an orientation in FIG. 1. Also, "upper" and "lower" each refer to an orientation in FIG. 1.

On a right side surface on the near side of the multilayer body 1, a termination terminal 3, a coupling terminal 2, and a first ground terminal 4 are sequentially provided.

On a left side surface of the multilayer body 1, a second ground terminal 5*a* is provided.

On a left side surface on the far side of the multilayer body 1, an input terminal 6, a second ground terminal 5*b*, and an output terminal 7 are sequentially provided.

On a right side surface of the multilayer body 1, a second ground terminal 5*c* is provided.

The coupling terminal 2, the termination terminal 3, the first ground terminal 4, the second ground terminals 5*a*, 5*b*, and 5*c*, the input terminal 6, and the output terminal 7 that are provided on the four side surfaces of the multilayer body 1 individually extend onto a lower main surface of the multilayer body 1 (insulator layer 1*a*) and an upper main surface of the multilayer body 1 (insulator layer 1*p*).

The coupling terminal 2, the termination terminal 3, the first ground terminal 4, the second ground terminals 5*a*, 5*b*, and 5*c*, the input terminal 6, and the output terminal 7 are preferably made of metal containing, as a main component, Ag, Cu, or an alloy of Ag and Cu, for example. On their surfaces, if preferred, one plated layer or a plurality of plated layers including, as a main component, Ni, Sn, or Au, for example, are provided.

As a material of the insulator layers 1*a* to 1*p* defining the multilayer body 1, ceramic is preferably used. The insulator layers 1*a* to 1*p* may each be understood as a dielectric layer with a dielectric constant.

A first ground electrode 8 and a second ground electrode 9*a* are provided on an upper main surface of the insulator layer 1*a*. The first ground electrode 8 is electrically connected to the first ground terminal 4. The second ground electrode 9*a* is electrically connected to the second ground terminals 5*a*, 5*b* and 5*c*.

A capacitor electrode 10*a* is provided on an upper main surface of the insulator layer 1*b*. A via electrode 11*a* also extends between both main surfaces of the insulator layer 1*b*. One end of the via electrode 11*a* is electrically connected to the capacitor electrode 10*a*, and the other end thereof is electrically connected to the first ground electrode 8 provided on the insulator layer 1*a*.

A capacitor electrode 10*b* is provided on an upper main surface of the insulator layer 1*c*.

Capacitor electrodes 10*c* and 10*d* are provided on an upper main surface of the insulator layer 1*d*. A via electrode 11*b* also extends between both main surfaces of the insulator layer 1*d*. The capacitor electrode 10*c* is electrically connected to the coupling terminal 2. One end of the via electrode 11*b* is exposed at the upper main surface of the insulator layer 1*d*, and the other end thereof is electrically connected to the capacitor electrode 10*b* provided on the insulator layer 1*c*.

A main line 12 is provided on an upper main surface of the insulator layer 1*e*. Via electrodes 11*c* and 11*d* also extend between both main surfaces of the insulator layer 1*e*. One end of the main line 12 is electrically connected to the input terminal 6, and the other end thereof is electrically connected to the output terminal 7. One end of the via electrode 11*c* is exposed at the upper main surface of the insulator layer 1*e*, and the other end thereof is electrically connected to the via electrode 11*b* provided through the insulator layer 1*d*. One end of the via electrode 11*d* is exposed at the upper main surface of the insulator layer 1*e*, and the other end thereof is electrically connected to the capacitor electrode 10*d* provided on the insulator layer 1*d*.

A first sub line 13*a* is provided on an upper main surface of the insulator layer 1*f*. Via electrodes 11*e* and 11*f* also extend between both main surfaces of the insulator layer 1*f*. One end of the via electrode 11*e* is electrically connected to one end of the first sub line 13*a*, and the other end thereof is electrically connected to the via electrode 11*d* provided through the insulator layer 1*e*. One end of the via electrode 11*f* is exposed at the upper main surface of the insulator layer 1*f*, and the other end thereof is electrically connected to the via electrode 11*c* provided through the insulator layer 1*e*.

A second sub line 13*b* is provided on an upper main surface of the insulator layer 1*g*. Via electrodes 11*g*, 11*h*, and 11*i* also extend between both main surfaces of the insulator layer 1*g*. One end of the second sub line 13*b* is electrically connected to the termination terminal 3. One end of the via electrode 11*g* is exposed at the upper main surface of the insulator layer 1*g*, and the other end thereof is electrically connected to the via electrode 11*f* provided through the insulator layer 1*f*. One end of the via electrode 11*h* is exposed at the upper main surface of the insulator layer 1*g*, and the other end thereof is electrically connected to the other end of the first sub line 13*a* provided on the insulator layer 1*f*. One end of the via electrode 11*i* is exposed at the upper main surface of the insulator layer 1*g*, and the other end thereof is electrically connected to the one end of the first sub line 13*a* provided on the insulator layer 1*f*.

A second ground electrode 9*b* is provided on an upper main surface of the insulator layer 1*h*. Via electrodes 11*j*, 11*k*, 11*l*, and 11*m* also extend between both main surfaces of the insulator layer 1*h*. The second ground electrode 9*b* is electrically connected to the second ground terminals 5*a*, 5*b* and 5*c*. One end of the via electrode 11*j* is exposed at the upper main surface of the insulator layer 1*h*, and the other end thereof is electrically connected to the other end of the second sub line 13*b* provided on the insulator layer 1*g*. One end of the via electrode 11*k* is exposed at the upper main surface of the insulator layer 1*h*, and the other end thereof is electrically connected to the via electrode 11*g* provided through the insulator layer 1*g*. One end of the via electrode 11*l* is exposed at the upper main surface of the insulator layer 1*h*, and the other end thereof is electrically connected to the via electrode 11*h* provided through the insulator layer 1*g*. One end of the via electrode 11*m* is exposed at the upper main surface of the insulator layer 1*h*, and the other end thereof is electrically connected to the via electrode 11*i* provided through the insulator layer 1*g*.

Capacitor electrodes 10*e* and 10*f* are provided on an upper main surface of the insulator layer 1*i*. Via electrodes 11*n*, 11*o*, 11*p*, and 11*q* also extend between both main surfaces of the insulator layer 1*i*. One end of the via electrode 11*n* is electrically connected to the capacitor electrode 10*e*, and the other end thereof is electrically connected to the via electrode 11*j* provided through the insulator layer 1*h*. One end of the via electrode 11*o* is electrically connected to the capacitor electrode 10*f*, and the other end thereof is electrically connected to the via electrode 11*l* provided through the insulator layer 1*h*. One end of the via electrode 11*p* is exposed at the upper main surface of the insulator layer 1*i*, and the other end thereof is electrically connected to the via electrode 11*k* provided through the insulator layer 1*h*. One end of the via electrode 11*q* is exposed at the upper main surface of the insulator layer 1*i*, and the other end thereof is electrically connected to the via electrode 11*m* provided through the insulator layer 1*h*.

Line electrodes 15*a* and 15*b* are provided on an upper main surface of the insulator layer 1*j*. Via electrodes 11*r*, 11*s*, 11*t*, and 11*u* also extend between both main surfaces of the insulator layer 1*j*. One end of the via electrode 11*r* is electrically connected to one end of the line electrode 15*a*, and the other end thereof is electrically connected to the capacitor electrode 10*e* provided on the insulator layer 1*i*. One end of the via electrode 11*s* is electrically connected to one end of the line electrode 15*b*, and the other end thereof is electrically connected to the capacitor electrode 10*f* provided on the insulator layer 1*i*. One end of the via electrode 11*t* is exposed at the upper main surface of the insulator layer 1*j*, and the other end thereof is electrically connected to the via electrode 11*p* provided through the insulator layer 1*i*. One end of the via electrode 11*u* is exposed at the upper main surface of the insulator layer 1*j*, and the other end thereof is electrically connected to the via electrode 11*q* provided through the insulator layer 1*i*.

Line electrodes 15*c*, 15*d*, and 15*e* are provided on an upper main surface of the insulator layer 1*k*. Via electrodes 11*v*, 11*w*, 11*x*, and 11*y* also extend between both main surfaces of the insulator layer 1*k*. One end of the via electrode 11*v* is electrically connected to one end of the line electrode 15*c*, and the other end thereof is electrically connected to the other end of the line electrode 15*a* provided on the insulator layer 1*j*. One end of the via electrode 11*w* is electrically connected to one end of the line electrode 15*d*, and the other end thereof is electrically connected to the other end of the line electrode 15*b* provided on the insulator layer 1*j*. One end of the via electrode 11*x* is electrically connected to a middle portion of the line electrode 15*e*, and the other end thereof is electrically connected to the via electrode 11*t* provided through the insulator layer 1*j*. One end of the via electrode 11*y* is exposed at the upper main surface of the insulator layer 1*k*, and the other end thereof is electrically connected to the via electrode 11*u* provided through the insulator layer 1*j*.

Line electrodes 15*f*, 15*g*, 15*h*, and 15*i* are provided on an upper main surface of the insulator layer 1*l*. Via electrodes 11*z*, 11A, 11B, 11C, and 11D also extend between both main surfaces of the insulator layer 1*l*. One end of the via electrode 11*z* is electrically connected to one end of the line electrode 15*f*, and the other end thereof is electrically connected to the other end of the line electrode 15*c* provided on the insulator layer 1*k*. One end of the via electrode 11A is electrically connected to one end of the line electrode 15*g*, and the other end thereof is electrically connected to the other end of the line electrode 15*d* provided on the insulator layer 1*k*. One end of the via electrode 11B is electrically connected to one end of the line electrode 15*h*, and the other end thereof is electrically connected to one end of the line electrode 15*e* provided on the insulator layer 1*k*. One end of the via electrode 11C is electrically connected to one end of the line electrode 15*i*, and the other end thereof is electrically connected to the other end of the line electrode 15*e* provided on the insulator layer 1*k*. One end of the via electrode 11D is exposed at the upper main surface of the insulator layer 1*l*, and the other end thereof is electrically connected to the via electrode 11*y* provided through the insulator layer 1*k*.

Line electrodes 15*j*, 15*k*, and 15*l* are provided on an upper main surface of the insulator layer 1*m*. Via electrodes 11E, 11F, 11G, 11H, and 11I also extend between both main surfaces of the insulator layer 1*m*. One end of the line electrode 15*k* is electrically connected to the coupling terminal 2. One end of the via electrode 11E is electrically connected to one end of the line electrode 15*j*, and the other end thereof is electrically connected to the other end of the line electrode 15*f* provided on the insulator layer 1*l*. One end of the via electrode 11F is electrically connected to the other end of the line electrode 15*j*, and the other end thereof is electrically connected to the other end of the line electrode 15*g* provided on the insulator layer 1*l*. One end of the via electrode 11G is electrically connected to the other end of the line electrode 15*k*, and the other end thereof is electrically connected to the other end of the line electrode 15*h* provided on the insulator layer 1*l*. One end of the via electrode 11H is electrically connected to one end of the line electrode 15*l*, and the other end thereof is electrically connected to the other end of the line electrode 15*i* provided on the insulator layer 1*l*. One end of the via electrode 11I is exposed at the upper main surface of the insulator layer 1*m*, and the other end thereof is electrically connected to the via electrode 11D provided through the insulator layer 1*l*.

A second ground electrode 9*c* and a line electrode 15*m* are provided on an upper main surface of the insulator layer 1*n*. Via electrodes 11J, 11K, and 11L also extend between both main surfaces of the insulator layer 1*n*. The second ground electrode 9*c* is electrically connected to the second ground terminals 5*a*, 5*b*, and 5*c*. One end of the via electrode 11J is electrically connected to one end of the line electrode 15*m*, and the other end thereof is electrically connected to the other end of the line electrode 15*l* provided on the insulator layer 1*m*. One end of the via electrode 11K is electrically connected to the other end of the line electrode 15*m*, and the other end thereof is electrically connected to the via electrode 11I provided through the insulator layer 1*m*. One end of the via electrode 11L is exposed at the upper main surface of the insulator layer 1*n*, and the other end thereof is electrically connected to a middle portion of the line electrode 15*j* provided on the insulator layer 1*m*.

A capacitor electrode 10*g* is provided on an upper main surface of the insulator layer 1*o*. A via electrode 11M also extends between both main surfaces of the insulator layer 1*o*. One end of the via electrode 11M is electrically connected to the capacitor electrode 10*g*, and the other end thereof is electrically connected to the via electrode 11L provided through the insulator layer 1*n*.

As described above, the coupling terminal 2, the termination terminal 3, the first ground terminal 4, the second ground terminals 5*a*, 5*b*, and 5*c*, the input terminal 6, and the output terminal 7 that extend from the four side surfaces of the multilayer body 1 (insulator layer 1*p*) are individually provided on the upper main surface of the insulator layer 1*p*.

As a material of the first ground electrode 8, the second ground electrodes 9*a* to 9*c*, the capacitor electrodes 10*a* to 10*g*, the via electrodes 11*a* to 11M, the main line 12, the first sub line 13*a*, the second sub line 13*b*, and the line electrodes 15*a* to 15*m*, metal preferably including, as a main component, Ag, Cu, or an alloy of Ag and Cu, for example, is used.

The directional coupler 100 according to the first preferred embodiment including the above structure may be manufactured by a typical manufacturing method applied to manufacture a directional coupler that includes a multilayer body including insulator layers stacked on top of one another.

FIG. 2 illustrates an equivalent circuit of the directional coupler 100 according to the first preferred embodiment.

The directional coupler 100 includes the first ground terminal 4, the second ground terminals 5*a*, 5*b*, and 5*c*, the input terminal 6, the output terminal 7, the coupling terminal 2, the termination terminal 3, the main line 12, a sub line including the first sub line 13*a* and the second sub line 13*b*, a first low pass filter LPF1, and a second low pass filter LPF2. The reason that the second ground terminals are denoted by three reference numerals 5*a*, 5*b*, and 5*c* in the above description is because the multilayer directional coupler 100 illustrated in FIG. 1 preferably includes three second ground terminals 5*a*, 5*b*, and 5*c*, for example. The number of second ground terminals is not limited to three, and the number of second ground terminals may be less than three, or may be more than three.

The main line 12 is electrically connected between the input terminal 6 and the output terminal 7.

The first low pass filter LPF1, the first sub line 13*a*, the second low pass filter LPF2, and the second sub line 13*b* are sequentially electrically connected between the coupling terminal and the termination terminal 3. The main line 12 is electromagnetically coupled to the sub line including the first sub line 13*a* and the second sub line 13*b*.

The first low pass filter LPF1 includes a first inductor L1, a second inductor L2, a first capacitor C1, a second capacitor C2, a third capacitor C3, and an additional inductor L11. In the first low pass filter LPF1, the coupling terminal 2 is electrically connected to one end of the first inductor L1. The other end of the first inductor L1 is electrically connected to one end of the second inductor L2. The other end of the second inductor L2 is electrically connected to the first sub line 13*a*. The first capacitor C1 is electrically connected in parallel with the first inductor L1. The second capacitor C2 is electrically connected in parallel with the second inductor L2. The third capacitor C3 and the additional inductor L11 are electrically connected between a connection point between the first inductor L1 and the second inductor L2 and the first ground terminal 4.

The second low pass filter LPF2 includes a third inductor L3, a fourth inductor L4, a fourth capacitor C4, a fifth capacitor C5, and a sixth capacitor C6. In the second low pass filter LPF2, the first sub line 13*a* is electrically connected to one end of the third inductor L3. The other end of the third inductor L3 is electrically connected to one end of the fourth inductor L4. The other end of the fourth inductor L4 is electrically connected to the second sub line 13*b*. The fourth capacitor C4 is electrically connected between a connection point between the first sub line 13*a* and the third inductor L3 and the second ground terminals 5*a*, 5*b*, and 5*c*. The fifth capacitor C5 is electrically connected between a connection point between the third inductor L3 and the fourth inductor L4 and the second ground terminals 5*a*, 5*b*, and 5*c*. The sixth capacitor C6 is electrically connected between a connection point between the fourth inductor L4 and the second sub line 13*b* and the second ground terminals 5*a*, 5*b* and 5*c*.

Next, the relationship between the structure and the equivalent circuit of the multilayer directional coupler 100 will be described with reference to FIGS. 1 and 2.

The main line 12 illustrated in FIG. 2 is provided on the insulator layer 1*e* illustrated in FIG. 1 and is electrically connected between the input terminal 6 and the output terminal 7.

The first sub line 13*a* illustrated in FIG. 2 is provided on the insulator layer 1*f* illustrated in FIG. 1.

The second sub line 13*b* illustrated in FIG. 2 is provided on the insulator layer 1*g* illustrated in FIG. 1, and the one end thereof is electrically connected to the termination terminal 3.

Next, the first low pass filter LPF1 illustrated in FIG. 2 will be described.

The first inductor L1 of the first low pass filter LPF1 is defined by a path electrically connecting the coupling terminal 2 to the middle portion of the line electrode 15*e* through the line electrode 15*k*, the via electrode 11G, the line electrode 15*h*, and the via electrode 11B, which are illustrated in FIG. 1. Furthermore, the middle portion of the line electrode 15*e* is the connection point between the first inductor L1 and the second inductor L2.

The second inductor L2 of the first low pass filter LPF1 is defined by a path electrically connecting the middle portion of the line electrode 15*e*, the via electrode 11C, the line electrode 15*i*, the via electrode 11H, the line electrode 15*l*, the via electrode 11J, the line electrode 15*m*, the via electrode 11K, the via electrode 11*l*, the via electrode 11D, the via electrode 11*y*, the via electrode 11*u*, the via electrode 11*q*, the via electrode 11*m*, and the via electrode 11*i*, which are illustrated in FIG. 1. Furthermore, the via electrode 11*i* is electrically connected to the one end of the first sub line 13*a*.

The first capacitor C1 of the first low pass filter LPF1 is defined by capacitance generated between the capacitor electrode 10*c* electrically connected to the coupling terminal 2 and the capacitor electrode 10*b* facing the capacitor electrode 10*c*. Furthermore, the capacitor electrode 10*b* is electrically connected to the middle portion of the line electrode 15*e*, which is the connection point between the first inductor L1 and the second inductor L2, through the via electrode 11*b*, the via electrode 11*c*, the via electrode 11*f*, the via electrode 11*g*, the via electrode 11*k*, the via electrode 11*p*, the via electrode 11*t*, and the via electrode 11*x*.

The second capacitor C2 of the first low pass filter LPF1 is defined by capacitance generated between the capacitor electrode 10*d* and the capacitor electrode 10*b* facing the capacitor electrode 10*d*. Furthermore, the capacitor electrode 10*d* is electrically connected to the one end of the first sub line 13*a* through the via electrode 11*d* and the via electrode 11*e*.

The third capacitor C3 of the first low pass filter LPF1 is defined by capacitance generated between the capacitor electrode 10*b* and the capacitor electrode 10*a* facing the capacitor electrode 10*b*. Furthermore, the capacitor electrode 10*a* is electrically connected to the first ground terminal 4 through the via electrode 11*a* and the first ground electrode 8. Then, the additional inductor L11 is defined by an inductance component generated by a portion of the capacitor electrode 10, the via electrode 11*a*, and the first ground electrode 8.

Next, the second low pass filter LPF2 illustrated in FIG. 2 will be described.

As described above, the second low pass filter LPF2 is electrically connected between the first sub line 13*a* and the second sub line 13*b*. A connection relationship among the second low pass filter LPF2, the first sub line 13*a*, and the second sub line 13*b* will be specifically described later.

The third inductor L3 of the second low pass filter LPF2 is defined by a path electrically connecting the via electrode 11*s*, the line electrode 15*b*, the via electrode 11*w*, the line electrode 15*d*, the via electrode 11A, the line electrode 15*g*, the via electrode 11F, and the middle portion of the line electrode 15*j*. Furthermore, the middle portion of the line electrode 15*j* is the connection point between the third inductor L3 and the fourth inductor L4.

The fourth inductor L4 of the second low pass filter LPF2 is defined by a path electrically connecting the middle portion of the line electrode 15*j*, the via electrode 11E, the line electrode 15*f*, the via electrode 11*z*, the line electrode 15*c*, the via electrode 11*v*, the line electrode 15*a*, and the via electrode 11*r*.

The fourth capacitor C4 of the second low pass filter LPF2 is defined by capacitance generated between the capacitor electrode 10*f* and the second ground electrode 9*b* facing the capacitor electrode 10*f*. Furthermore, the capacitor electrode 10*f* is electrically connected to the via electrode 11*s*, which is the one end of the third inductor L3.

The fifth capacitor C5 of the second low pass filter LPF2 is defined by capacitance generated between the capacitor electrode 10*g* and the second ground electrode 9*c* facing the capacitor electrode 10*g*. Furthermore, the capacitor electrode 10*g* is electrically connected to the middle portion of the line electrode 15*j*, which is the connection point between the third inductor L3 and the fourth inductor L4, through the via electrode 11M and the via electrode 11L.

The sixth capacitor C6 of the second low pass filter LPF2 is defined by capacitance generated between the capacitor electrode 10*e* and the second ground electrode 9*b* facing the capacitor electrode 10*e*. Furthermore, the capacitor electrode 10*e* is electrically connected to the via electrode 11*r*, which is the other end of the fourth inductor L4.

One end of the second low pass filter LPF2 (the via electrode 11*s*, which is the one end of the third inductor L3, and the capacitor electrode 10*f*, which is one capacitor electrode of the fourth capacitor C4) is electrically connected to the other end of the first sub line 13*a* through a line electrically connecting the via electrodes 11*o*, 11*l*, and 11*h*.

The other end of the second low pass filter LPF2 (the via electrode 11*r*, which is the other end of the fourth inductor L4, and the capacitor electrode 10*e*, which is one capacitor electrode of the sixth capacitor C6) is electrically connected to the other end of the second sub line 13*b* through a line electrically connecting the via electrodes 11*n* and 11*j*.

The second ground electrode 9*b* defining the respective other capacitor electrodes of the fourth capacitor C4 and the sixth capacitor C6, and the second ground electrode 9*b* defining the other capacitor electrode of the capacitor 5 are each electrically connected to the three second ground terminals 5*a*, 5*b*, and 5*c*.

Furthermore, the second ground electrode 9*a* defining and functioning as a floating electrode within the multilayer body 1 is also electrically connected to the three second ground terminals 5*a*, 5*b*, and 5*c*.

In the directional coupler 100 according to the present preferred embodiment, the first ground terminal 4 and the second ground terminals 5*a*, 5*b*, and 5*c* are preferably provided so that the first ground terminal 4 is isolated from the second ground terminals 5*a*, 5*b*, and 5*c*. That is, in the directional coupler 100, the first ground terminal 4 and the second ground terminals 5*a*, 5*b*, and 5*c* are provided so that the first ground terminal 4 is isolated from the second ground terminals 5*a*, 5*b*, and 5*c*, thus significantly reducing or preventing unnecessary leakage of a signal from occurring.

Furthermore, in the directional coupler 100 according to this preferred embodiment, in the multilayer body 1, a second ground electrode is divided and formed into the second ground electrode 9*a* and the second ground electrode 9*b* that are located on respective different layers, and the main line 12 and the sub line (the first sub line 13*a* and the second sub line 13*b*) are sandwiched from above and below by the second ground electrode 9*a* and the second ground electrode 9*b*. As a result, in the directional coupler 100, the main line 12 and the sub line (the first sub line 13*a* and the second sub line 13*b*) are prevented from being affected by a noise signal from the outside.

Furthermore, in the directional coupler 100 according to this preferred embodiment, when the multilayer body 1 is viewed in perspective in a stacking direction, the first low pass filter LPF1 and the first ground electrode 8 at least partially overlap each other, but the first low pass filter LPF1 does not overlap the second ground electrodes 9*a*, 9*b*, and 9*c*. In FIG. 1, the first low pass filter LPF1 is included in a near-side half region of the multilayer body 1. As a result, in the directional coupler 100, the number of ground electrodes acting as a barrier to a magnetic field generated by an inductor of the first low pass filter LPF1 is small, attenuation on a higher-frequency side than a frequency band used in coupling is increased, and coupling characteristics are significantly improved.

Based on the connection relationship described above, the multilayer directional coupler 100 illustrated in FIG. 1 defines the equivalent circuit illustrated in FIG. 2.

Next, characteristics of the directional coupler 100 according to the first preferred embodiment will be described.

Figure 3:
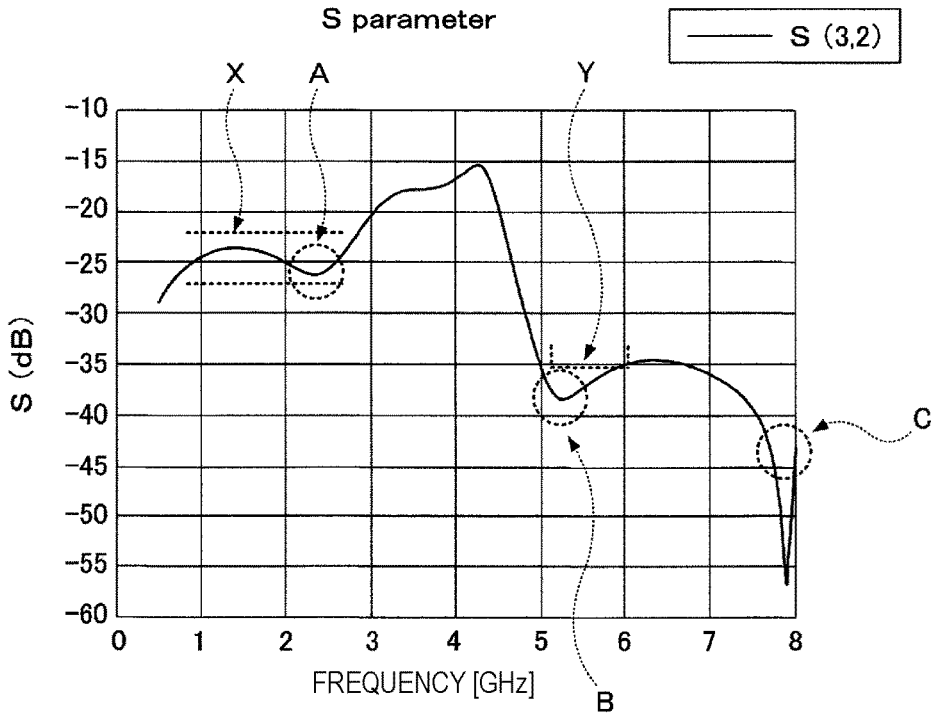
FIG. 3 is a graph illustrating coupling characteristics of the directional coupler shown in FIG. 1.

FIG. 3 illustrates coupling characteristics of the directional coupler 100. The coupling characteristics refer to the amount of a signal flowing from the input terminal 6 illustrated in FIGS. 1 and 2 to the coupling terminal 2.

Figure 4:
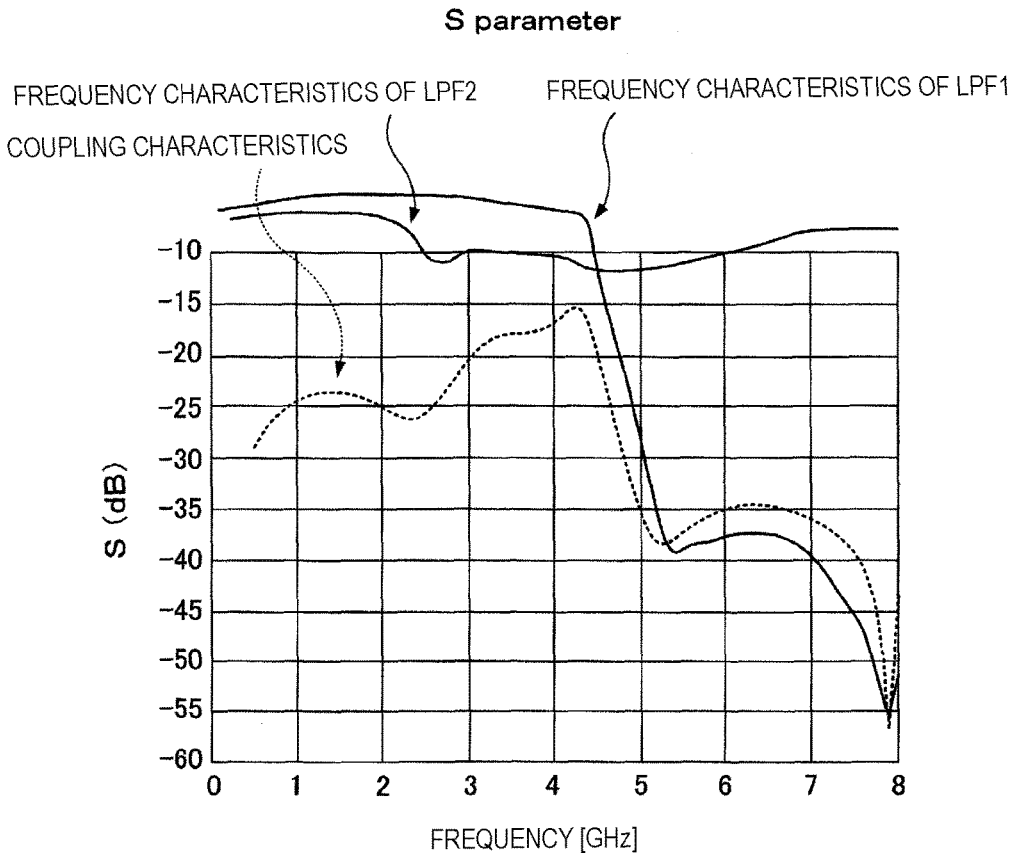
FIG. 4 is a graph illustrating frequency characteristics of a first low pass filter LPF1 and a second low pass filter LPF2 included in the directional coupler shown in FIG. 1.

FIG. 4 illustrates frequency characteristics of the first low pass filter LPF1 and the second low pass filter LPF2 of the directional coupler 100. FIG. 4 also illustrates the coupling characteristics of the directional coupler 100.

Figure 5:
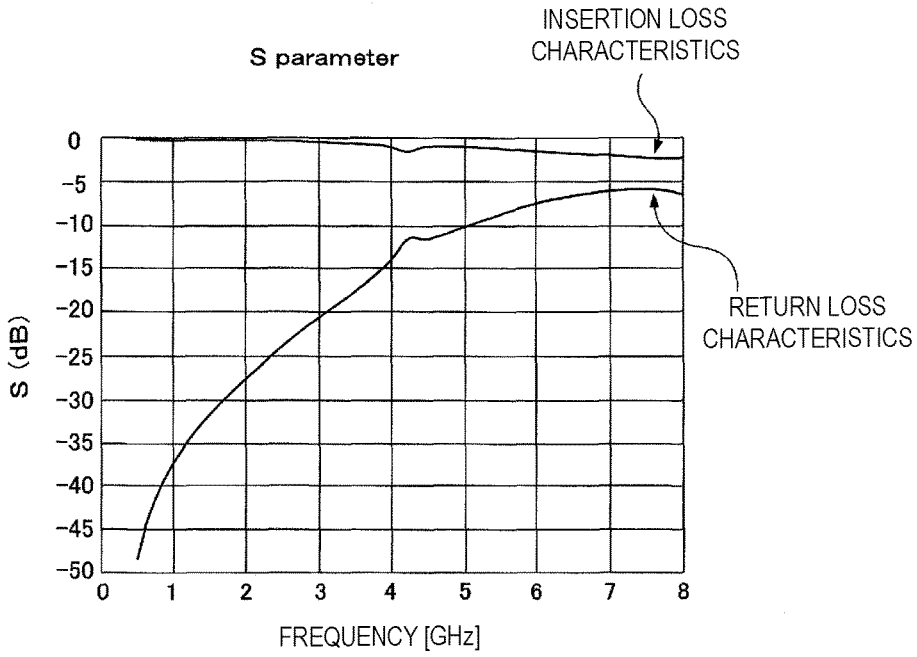
FIG. 5 is a graph illustrating insertion loss characteristics and return loss characteristics of the directional coupler shown in FIG. 1.

FIG. 5 illustrates insertion loss characteristics and return loss characteristics of the directional coupler 100. The insertion loss characteristics herein refer to characteristics representing a loss in a signal path from the input terminal 6 to the output terminal 7. The return loss characteristics herein refer to a signal ratio of a signal returned to the input terminal 6 to the signal input from the input terminal 6.

Figure 6:
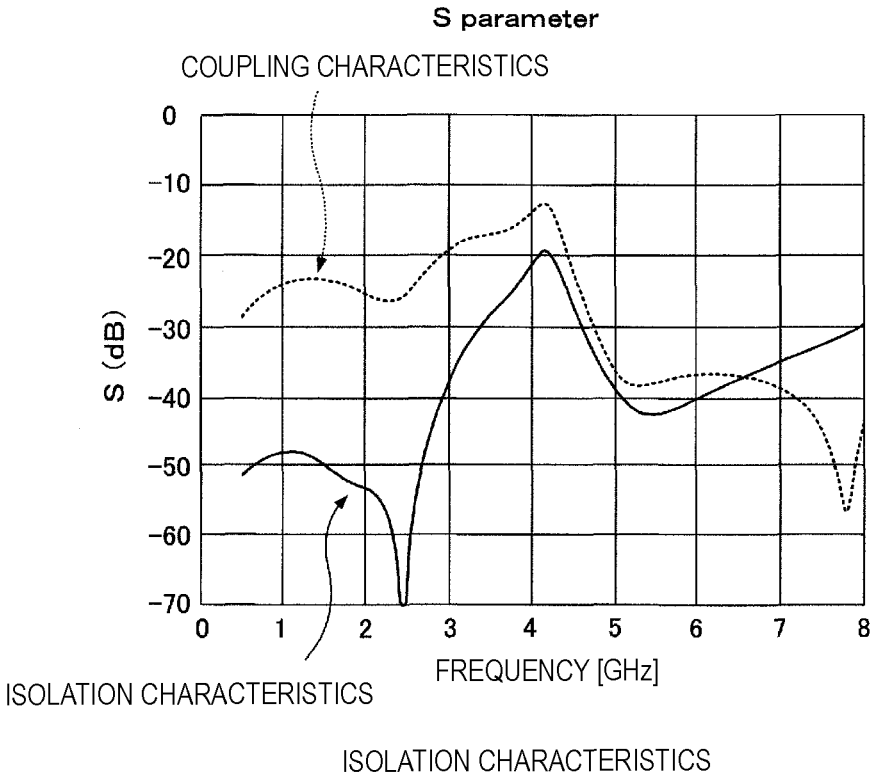
FIG. 6 is a graph illustrating isolation characteristics of the directional coupler shown in FIG. 1.

FIG. 6 illustrates isolation characteristics of the directional coupler 100. FIG. 6 also illustrates the coupling characteristics of the directional coupler 100. The isolation characteristics refer to a signal ratio of a signal output from the output terminal 7 to the coupling terminal 2.

Figure 7:
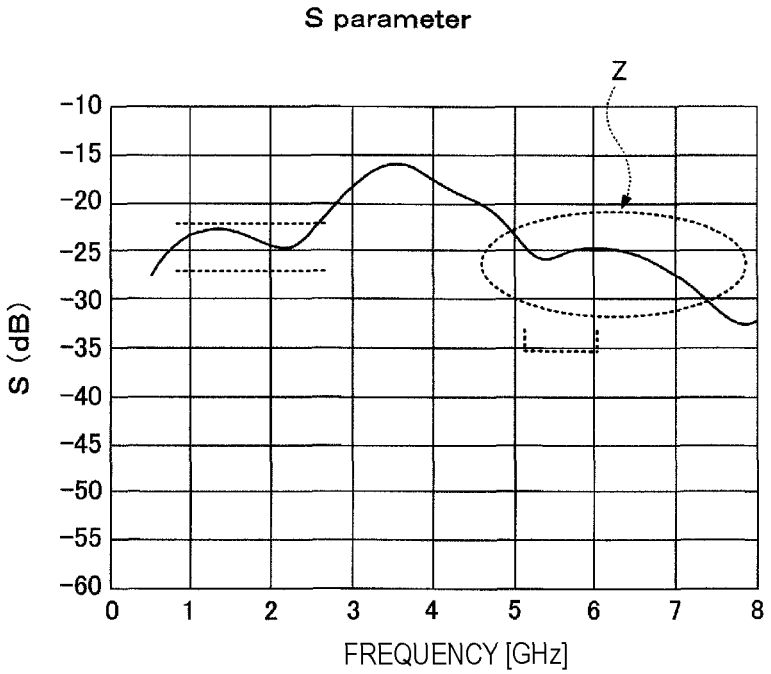
FIG. 7 is a graph illustrating coupling characteristics of a directional coupler according to a comparative example.

Furthermore, for purposes of comparison, FIG. 7 illustrates coupling characteristics in the case where a ground electrode is not divided (isolated) into the first ground electrode 8 and the second ground electrodes 9*a*, 9*b*, and 9*c*, and where a ground terminal is also not divided (isolated) into the first ground terminal 4 and the second ground terminals 5*a*, 5*b*, and 5*c*. For example, there is a case where the first ground electrode 8 and the second ground electrode 9*a* that are provided on the upper main surface of the insulator layer 1*a* are not isolated from each other and are integrated (see FIG. 1).

As illustrated in FIG. 3, in the directional coupler 100, coupling characteristics are flat or substantially flat at attenuations ranging from about 23 dB to about 28 dB over a wide band width from about 0.7 GHz to about 2.7 GHz. Furthermore, attenuations of about 35 dB or more are provided in a frequency band from about 5.1 GHz to about 6.0 GHz on a high-frequency side, thereby significantly reducing unnecessary coupling.

In FIG. 3, a region from about 0.7 GHz to about 2.7 GHz in which flattening is achieved at attenuations ranging from about 23 dB to about 28 dB is denoted by X, and a region from about 5.1 GHz to about 6.0 GHz in which attenuations of about 35 dB or more are provided is denoted by Y.

Such excellent coupling characteristics are achieved for the reasons discussed below.

First, an attenuation due to the second low pass filter LPF2 is included in a region denoted by A in FIG. 3, thus contributing to excellent coupling characteristics. As illustrated in FIG. 4, a cutoff frequency of the second low pass filter LPF2 is present at about 2.3 GHz.

Furthermore, an attenuation due to the first low pass filter LPF1 is included in a region denoted by B in FIG. 3, thus contributing to excellent coupling characteristics. As illustrated in FIG. 4, a cutoff frequency of the first low pass filter LPF1 is present at about 4.4 GHz. To provide an attenuation in the region B, it is important that a ground electrode is divided (isolated) into the first ground electrode 8 and the second ground electrodes 9*a*, 9*b*, and 9*c*, and that a ground terminal is also divided (isolated) into the first ground terminal 4 and the second ground terminals 5*a*, 5*b*, and 5*c*. This is because, if these are not divided (isolated), as described later, leakage of a signal occurs, and no intended attenuation is able to be provided.

Furthermore, an attenuation due to the additional inductor L11 added to the first low pass filter LPF1 is included in a region denoted by C in FIG. 3, thus providing a significant reduction in coupling in an unnecessary frequency band.

On the other hand, as illustrated in FIG. 7, in a directional coupler in which a ground electrode is not divided (isolated) into the first ground electrode 8 and the second ground electrodes 9*a*, 9*b*, and 9*c*, and in which a ground terminal is also not divided (isolated) into the first ground terminal 4 and the second ground terminals 5*a*, 5*b*, and 5*c*, a preferred attenuation is not provided in a region denoted by Z due to leakage of a signal. In the frequency band from about 5.1 GHz to about 6.0 GHz in particular, attenuations of about 35 dB or more are not provided, and the directional coupler does not satisfy standards demanded of a product.

Thus, in the directional coupler 100 according to the first preferred embodiment, it has been discovered that a curve of the degree of coupling is flat or substantially flat over a wide frequency band, and that coupling in an unnecessary frequency band is significantly reduced.

Second Preferred Embodiment

Figure 8:
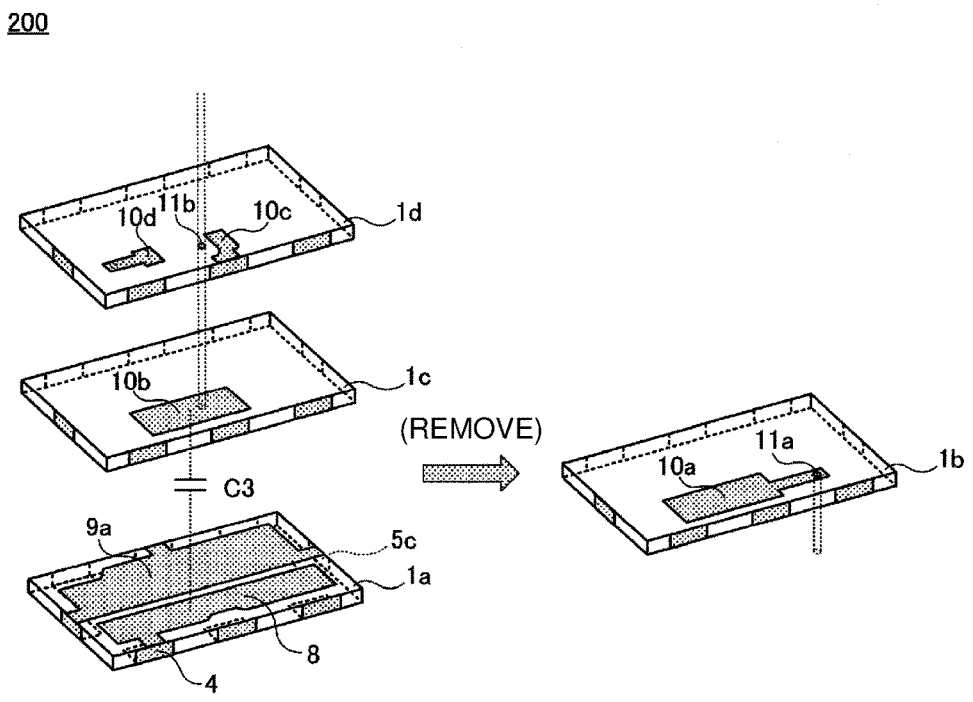
FIG. 8 is an exploded perspective view illustrating principal components of a directional coupler according to a second preferred embodiment of the present invention.
Figure 9:
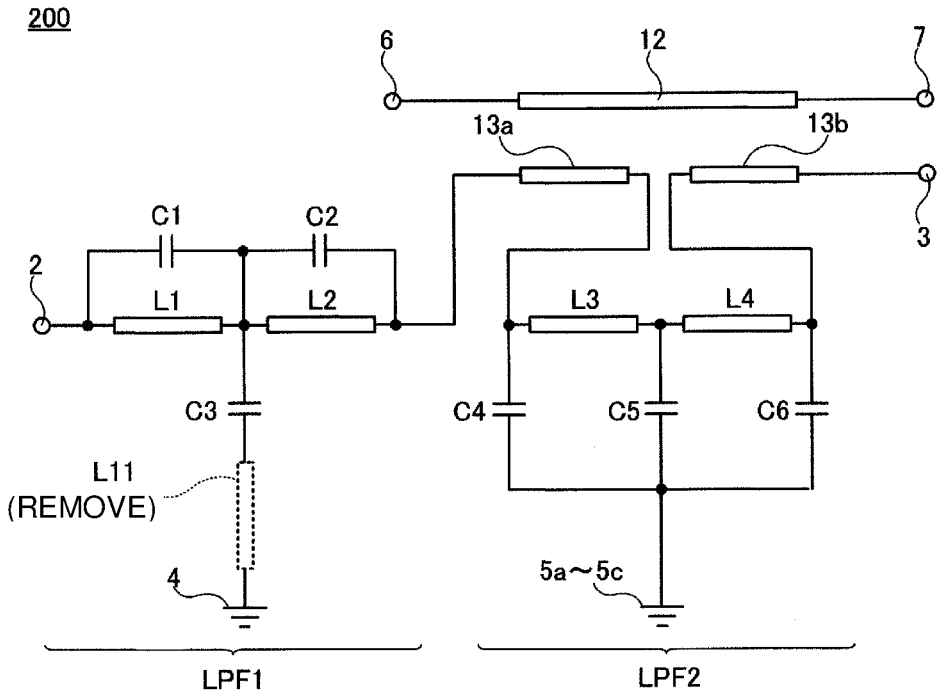
FIG. 9 is an equivalent circuit diagram of the directional coupler shown in FIG. 8.

FIGS. 8 and 9 each illustrate a directional coupler 200 according to a second preferred embodiment of the present invention. Note that FIG. 8 is an exploded perspective view of principal components of the directional coupler 200 that includes a multilayer body including a plurality of insulator layers stacked on top of one another. FIG. 9 illustrates an equivalent circuit into which the exploded perspective view of the principal components of FIG. 8 is transformed.

In the directional coupler 100 according to the first preferred embodiment illustrated in FIGS. 1 and 2, as illustrated in FIG. 2, the additional inductor L11 is provided between the third capacitor C3 and the first ground terminal 4 by an inductance component generated by a portion of the capacitor electrode 10 and the via electrode 11*a* that are provided on the insulator layer 1*b*, and the first ground electrode 8 provided on the insulator layer 1*a*, which are illustrated in FIG. 1.

In the directional coupler 200 according to the second preferred embodiment, the insulator layer 1*b* is removed as illustrated in FIG. 8, and the additional inductor L11 is removed as illustrated in FIG. 9. The third capacitor C3 illustrated in FIG. 9 is defined by capacitance generated between the capacitor electrode 10*b* and the first ground electrode 8 as illustrated in FIG. 8.

Figure 10:
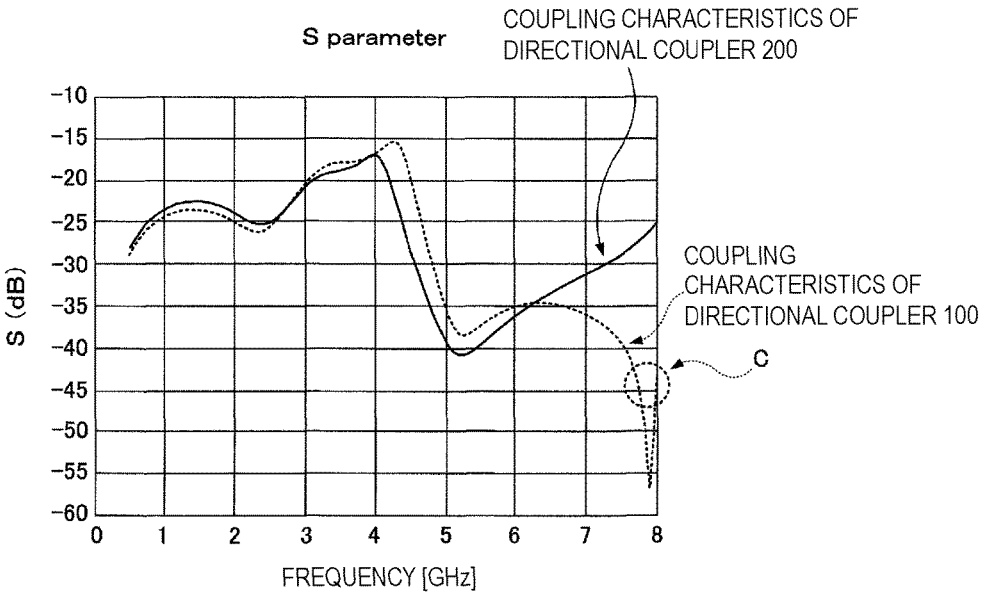
FIG. 10 is a graph illustrating a comparison of the coupling characteristics of the directional coupler shown in FIG. 1 and coupling characteristics of the directional coupler shown in FIG. 8.

FIG. 10 illustrates coupling characteristics of the directional coupler 200. FIG. 10 also illustrates the coupling characteristics of the directional coupler 100.

As is evident from FIG. 10, in the coupling characteristics of the directional coupler 200, an attenuation pole provided at about 8 GHz represented by the region C in the coupling characteristics of the directional coupler 100 disappears, and characteristics on a higher-frequency side than about 6 GHz increase sharply. Note that preferred attenuations of about 35 dB or more are provided in the frequency band from about 5.1 GHz to about 6.0 GHz.

Thus, it has been discovered that, as in the directional coupler 100 according to the first preferred embodiment, when the additional inductor L11 is included between the third capacitor C3 and the first ground terminal 4 of the first low pass filter LPF1, a pole is provided at about 8 GHz, and that a large attenuation is provided on the higher-frequency side than about 6 GHz.

However, when no large attenuation is preferred on the higher-frequency side than about 6 GHz, as in the directional coupler 200 according to the second preferred embodiment, the additional inductor L11 may be removed. In this case, one insulator layer (insulator layer 1*b*) stacked in the multilayer body 1 is removed, thus providing a significant reduction in the height of the directional coupler.

Third Preferred Embodiment

Figure 11:
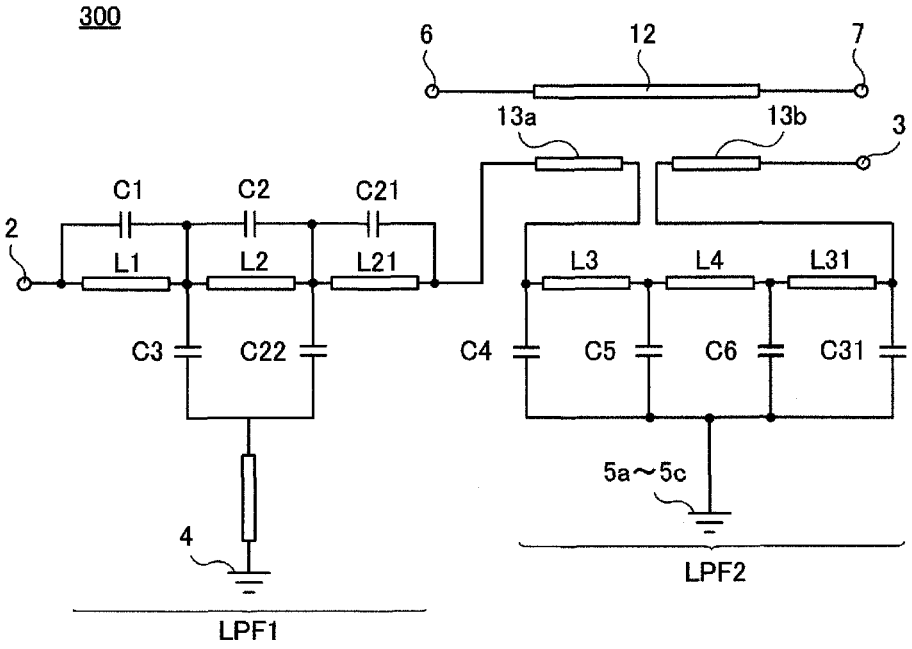
FIG. 11 is an equivalent circuit diagram of a directional coupler according to a third preferred embodiment of the present invention.

FIG. 11 illustrates an equivalent circuit of a directional coupler 300 according to a third preferred embodiment of the present invention.

In the directional coupler 100 illustrated in FIGS. 1 and 2, the first low pass filter LPF1 and the second low pass filter LPF2 each include two stages.

On the other hand, in the directional coupler 300, as illustrated in FIG. 11, an additional inductor L21, and additional capacitors C21 and C22 are added to the first low pass filter LPF1 to provide a three-stage structure. Furthermore, in the directional coupler 300, as similarly illustrated in FIG. 11, an additional inductor L31 and an additional capacitor C31 are added to the second low pass filter LPF2 to provide a three-stage structure.

In the directional coupler 300, the number of stages of the first low pass filter LPF1 and the number of stages of the second low pass filter LPF2 are each preferably increased to three, thus making coupling characteristics more flat in a wide band width, and significantly reducing coupling in an unnecessary frequency band further.

The directional couplers 100 to 300 according to the first to third preferred embodiments have been described above. However, the preferred embodiments of the present invention are not limited to the above descriptions, and various modifications may be made in accordance with the scope and spirit of the present invention.

For example, each directional coupler according to the preferred embodiments of the present invention is not necessarily structured with a multilayer body including insulator layers stacked on top of one another, and may include discrete electronic components mounted on a board.

In the directional couplers 100 and 200 according to the first and second preferred embodiments, the number of stages of the first low pass filter LPF1 and the number of stages of the second low pass filter LPF2 are each preferably two, for example. In the directional coupler 300 according to the third preferred embodiment, the number of stages of the first low pass filter LPF1 and the number of stages of the second low pass filter LPF2 are each preferably three, for example. However, the number of stages of the first low pass filter LPF1 and the number of stages of the second low pass filter LPF2 may each be any suitable number. The number of stages may be a number greater than two or three, or a number less than two or three. Furthermore, the number of stages of the first low pass filter LPF1 does not have to be equal to the number of stages of the second low pass filter LPF2. The number of stages of the first low pass filter LPF1 may be different from the number of stages of the second low pass filter LPF2. For example, although, in the directional coupler 300 according to the third preferred embodiment, both of the number of stages of the first low pass filter LPF1 and the number of stages of the second low pass filter LPF2 are increased to three, only the number of stages of the first low pass filter LPF1 or the second low pass filter LPF2 may be increased.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A directional coupler comprising:

an input terminal;

an output terminal;

a coupling terminal;

a termination terminal;

a ground terminal;

a main line electrically connected between the input terminal and the output terminal; and a sub line electrically connected between the coupling terminal and the termination terminal; wherein the main line and the sub line are spaced away from each other;

the sub line is divided into a plurality of sub lines electrically connected to each other and includes at least a first sub line and at least a second sub line;

a first low pass filter is included between the coupling terminal and the sub line;

a second low pass filter is included between the first sub line and the second sub line;

the ground terminal includes a plurality of ground terminals including at least a first ground terminal and at least a second ground terminal that are isolated from each other; and the first low pass filter is electrically connected to the first ground terminal, and the second low pass filter is electrically connected to the second ground terminal.

2. The directional coupler according to claim 1, wherein the first low pass filter includes at least a first inductor, at least a second inductor, at least a first capacitor, at least a second capacitor, and at least a third capacitor;

the coupling terminal is electrically connected to one end of the first inductor;

another end of the first inductor is electrically connected to one end of the second inductor;

another end of the second inductor is electrically connected to the sub line;

the first capacitor is electrically connected in parallel with the first inductor;

the second capacitor is electrically connected in parallel with the second inductor;

the third capacitor is electrically connected between a connection point between the first inductor and the second inductor and the first ground terminal;

the second low pass filter includes at least a third inductor, at least a fourth inductor, at least a fourth capacitor, at least a fifth capacitor, and at least a sixth capacitor;

the first sub line is electrically connected to one end of the third inductor;

another end of the third inductor is electrically connected to one end of the fourth inductor;

another end of the fourth inductor is electrically connected to the second sub line;

the fourth capacitor is electrically connected between a connection point between the first sub line and the third inductor and the second ground terminal;

the fifth capacitor is electrically connected between a connection point between the third inductor and the fourth inductor and the second ground terminal; and the sixth capacitor is electrically connected between a connection point between the fourth inductor and the second sub line and the second ground terminal.

3. The directional coupler according to claim 1, wherein in the first low pass filter, one additional inductor or a plurality of additional inductors electrically connected in series with each other are included between the second inductor and the sub line; and one additional capacitor or a plurality of additional capacitors are respectively electrically connected in parallel with the one additional inductor or the plurality of additional inductors;

in a case of the one additional inductor, the one additional capacitor is included between a connection point between the second inductor and the one additional inductor and the first ground terminal; and in a case of the plurality of additional inductors, each of the plurality of additional capacitors is respectively included between a connection point between the second inductor and one of the plurality of additional inductors and the first ground terminal, and between a connection point between the one of the plurality of additional inductors and the one of the plurality of additional inductors and the first ground terminal.

4. The directional coupler according to claim 1, wherein in the second low pass filter, one additional inductor or a plurality of additional inductors electrically connected in series with each other are included between the fourth inductor and the second sub line;

in a case of the one additional inductor, an additional capacitor is included between a connection point between the one additional inductor and the second sub line and the second ground terminal; and in a case of the plurality of additional inductors, each of a plurality of additional capacitors is respectively included between a connection point between the additional inductor and one of the plurality of additional inductors and the second ground terminal, and between a connection point between the one of the plurality of additional inductors and the second sub line and the second ground terminal.

5. The directional coupler according to claim 1, wherein a cutoff frequency of the first low pass filter is different from a cutoff frequency of the second low pass filter; and the cutoff frequency of the first low pass filter is on a higher-frequency side than the cutoff frequency of the second low pass filter.

6. The directional coupler according to claim 1, wherein an additional inductor is further included in a connection path between the first low pass filter and the first ground terminal.

7. The directional coupler according to claim 1, the directional coupler further comprising:

a multilayer body including a plurality of insulator layers stacked on top of one another; wherein a first ground electrode is provided in a first interlayer space between the plurality of insulator layers;

a second ground electrode is provided in a second interlayer space between the plurality of insulator layers;

in the multilayer body, the first ground electrode and the second ground electrode are isolated from each other;

the first low pass filter is electrically connected to the first ground electrode;

the second low pass filter is electrically connected to the second ground electrode;

the first ground electrode is electrically connected to the first ground terminal; and the second ground electrode is electrically connected to the second ground terminal.

8. The directional coupler according to claim 7, wherein in the multilayer body, the second ground electrode is divided into and located in two or more interlayer spaces between the insulator layers;

in the multilayer body, the main line and the sub line are individually sandwiched from above and below by the divided second ground electrodes in the two or more interlayer spaces; and when the multilayer body is viewed in perspective in a stacking direction, the divided second ground electrodes in the two or more interlayer spaces at least partially overlap the main line and the sub line.

9. The directional coupler according to claim 7, wherein when the multilayer body is viewed in perspective in a stacking direction, the first low pass filter and the first ground electrode at least partially overlap each other, but the first low pass filter does not overlap the second ground electrode.

10. The directional coupler according to claim 7, wherein the coupling terminal, the termination terminal, the first ground terminal, the second ground terminal, the input terminal, and the output terminal are provided on side surfaces of the multilayer body and individually extend onto a lower main surface of the multilayer body and an upper main surface of the multilayer body.

11. The directional coupler according to claim 7, wherein the second ground terminal includes a plurality of second ground terminals that are provided on at least two different side surfaces of the multilayer body.

12. The directional coupler according to claim 7, wherein the first ground electrode and the second ground electrode are provided on a same surface of a same insulator layer of the plurality of insulator layers.

13. The directional coupler according to claim 1, wherein the main line is electromagnetically coupled to the sub line.

14. The directional coupler according to claim 2, wherein the first inductor is defined by a path electrically connecting the coupling terminal to a middle portion of a line electrode.

15. The directional coupler according to claim 2, wherein the second inductor is defined by a path including a plurality of line electrodes and a plurality of via electrodes.

16. The directional coupler according to claim 2, wherein the first capacitor is defined by a capacitance generated between a first capacitor electrode electrically connected to the coupling terminal and a second capacitor electrode that faces the first capacitor electrode.

17. The directional coupler according to claim 2, wherein the second capacitor is defined by a capacitance generated between a first capacitor electrode electrically connected to the sub line and a second capacitor electrode that faces the first capacitor electrode.

18. The directional coupler according to claim 2, wherein the third capacitor is defined by a capacitance generated between a first capacitor electrode electrically connected to the first ground terminal and a second capacitor electrode that faces the first capacitor electrode.

19. The directional coupler according to claim 1, the first capacitor, the second capacitor, and the third capacitor include a common capacitor electrode.

* * * * *